United States Patent [19]

Grieder

[11] 4,114,308

[45] Sep. 19, 1978

[54] AERODYNAMICALLY DRIVEN TOY

[76] Inventor: Charles K. Grieder, 727 S. Lyon #107, Santa Ana, Calif. 92705

[21] Appl. No.: 819,351

[22] Filed: Jul. 27, 1977

[51] Int. Cl.[2] ..... A63H 33/40

[52] U.S. Cl. ..... 46/53; 46/124

[58] Field of Search ..... 46/44, 53, 55, 124; 40/106.33

[56] References Cited

U.S. PATENT DOCUMENTS

| | | | |
|---|---|---|---|
| 2,704,909 | 3/1955 | Lamkin | 46/55 |
| 4,030,237 | 6/1977 | Lewis | 46/53 |

*Primary Examiner*—Louis G. Mancene
*Assistant Examiner*—Robert F. Cutting
*Attorney, Agent, or Firm*—George F. Bethel; Patience K. Bethel

[57] ABSTRACT

The following specification discloses an aerodynamically driven toy that can be in the form of a toy or other animal having a moving appendage such as a tail or wing. The wing, tail or other appendage is driven aerodynamically when passing through a relative wind by virtue of the fact that a turning moment is applied respectively for both negative and positive angles of attack after the appendage, such as the wing of a bird, has been moved through the reverse of the foregoing movement. The angle of attack is changed by virtue of an operating arm that is linked to the wing or appendage so that it moves in a manner whereby the wing will be positively driven upwardly and downwardly at the respective low points and high points of the travel of the wing. This is done by means of turning the wings in a direction to apply a certain angle of attack so that the relative wind will pick up the wing when it is in its lower position and depress it when it is in its upper position. The foregoing aerodynamically driven toy can be attached to a moving vehicle by means of a connector that can either wrap around a portion of a vehicle or be inserted in any other suitable manner to the vehicle's frame or structure. The effect is to create a flapping movement of a wing or other appendage of an animal.

6 Claims, 17 Drawing Figures

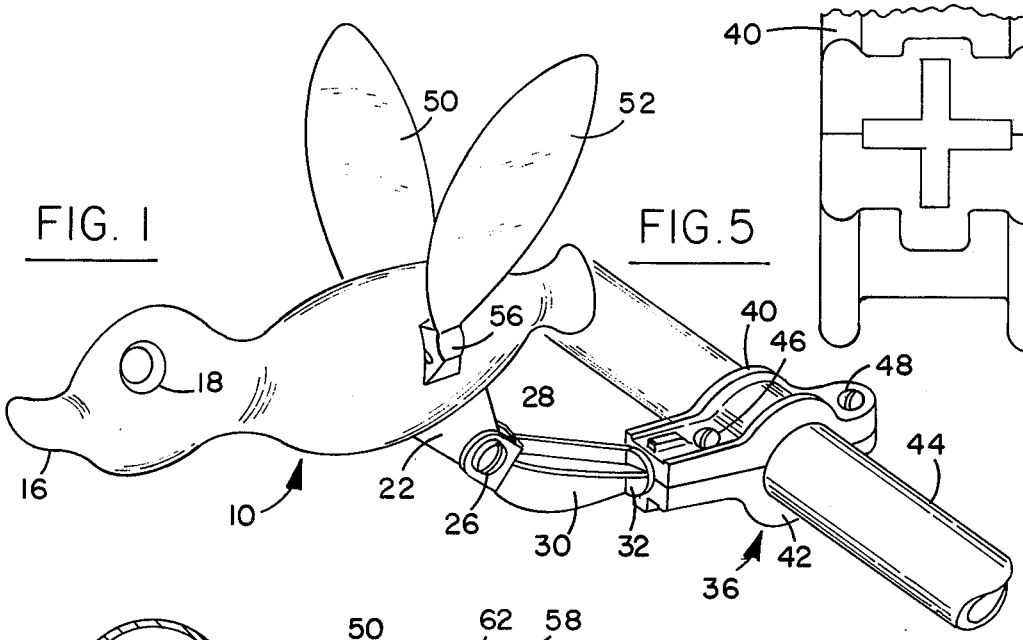
FIG. 1
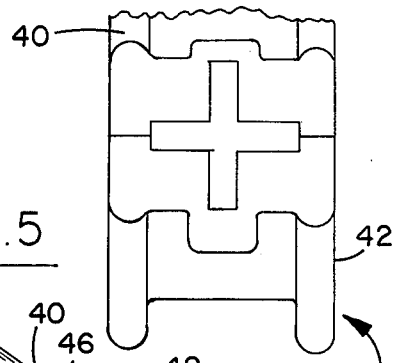
FIG. 5
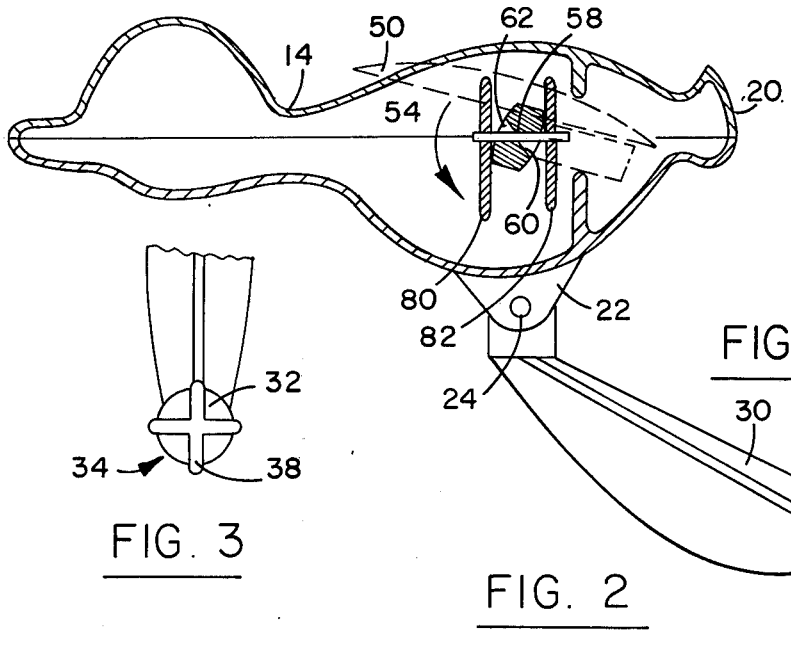
FIG. 2
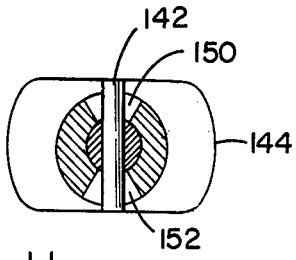
FIG. 11
FIG. 3
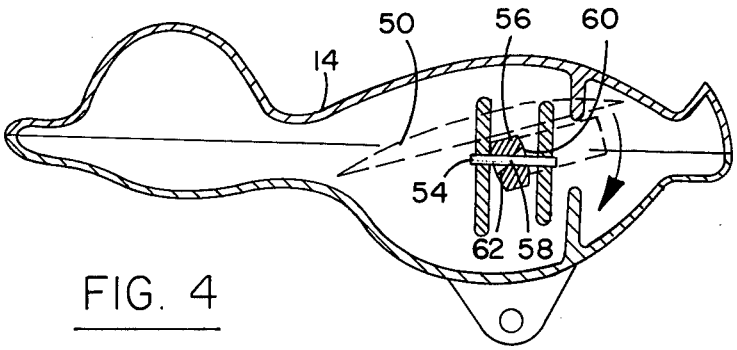
FIG. 4

AERODYNAMICALLY DRIVEN TOY

BACKGROUND OF THE INVENTION

1. Field of the Invention

The field of this invention lies within the toy art. More particularly, it lies within the art wherein a movable toy is driven by aerodynamic means, such as the relative wind or passing breeze when a vehicle moves through the air.

2. The Prior Art

The prior art related to animated or moving toys, generally relies upon a mechanical drive that is either mechanically driven by springs or other means such as electrically. Such drives create animation or movement through various means. Furthermore, it is known that there are various animals that can provide certain animation or movement when they are caused to move through the wind.

Recently, it has been possible to implace such animated moving animals on vehicles to allow them to have the appearance of a live moving animal. However, to date there has not been any practical animal movement that can be merely aerodynamically driven to provide the effect of moving wings or a wagging tail to render the appearance of a moving animal.

This invention is directed toward the idea of providing animal movements that render the appearance of a moving pair of wings or a moving tail. Such movement is caused by means of having a wing being driven at a positive angular attack moved to an upper extreme position and then rotated by means of an operating arm to put it into a negative angle of attack, so that it will then be driven downwardly by the relative wind. At the end of the travel of the wing, or its bottoming out, it is attendantly turned upwardly again by the operating arm so as to rotate it into a positive angle of attack and drive it upwardly. The foregoing creates a constant flapping appearance and movement of the wing for the extended period of time in which the wing moves through the wind in an aerodynamic manner.

Attendant with the foregoing is an alternative embodiment of this invention which allows a tail or other appendage to move backwardly and forwardly by virtue of being tossed into positive angles at the end of its cycle of movement. This is done by way of angling the connection means into a positive angle of attack, so that it will move dynamically backwardly and forwardly in the manner of a wagging tail.

The foregoing features allow this invention to be a substantial step over the prior art by allowing aerodynamic forces to drive the wings or appendages of an animal backwardly and forwardly to give them the appearance of movement.

SUMMARY OF THE INVENTION

In summation, this invention comprises a new means of allowing aerodynamic forces to provide movement and the appearance of animation to animals moving through the wind.

More specifically, it allows a vehicle to have a certain degree of animation to it, such as a child's bicycle or other wheeled vehicle. The invention incorporates a bird or an animal with an appendage that moves backwardly and forwardly. The movement is incorporated within the framework or reference of a normal flapping movement by virtue of aerodynamic forces providing alternative positive and negative lift.

The appendages, such as the wings, are attached in a pivotal manner to the bird so that they can move upwardly and downwardly. The general characteristic is such that they have a configuration conformed generally to a wing or other movement which can have a positive lifting moment applied thereto. The lifting moment causes the wing to be lifted upwardly to an upper position, at which time it is turned downwardly to allow negative lift to push the wing into a downward position, at which time it is then turned upwardly to allow positive lift to lift the wing upwardly. As will be seen, the intermittent upward and downward movement allows a flapping if sufficient speed and aerodynamic forces pass over the wing.

The foregoing movement is accomplished by the wing having an ultimate distance to which it travels upwardly and downwardly, at which point it is respectively turned from the upward position downwardly to apply negative lift so that it moves forcefully downwardly. In the bottom position, it is turned upwardly to obtain positive lift and driven upwardly to repeat the cycle.

Thus, it can move upwardly and downwardly to render the appearance of a flapping wing. The foregoing enhances the entire operation and appearance of an animated animal, so that it need not be driven by any force other than relative wind travelling over its surfaces. As will be understood, the advance is substantial over the prior art in allowing animation and the appearance of movement of animals.

DESCRIPTION OF THE DRAWINGS

The invention will be more clearly understood by reference to the description below taken in conjunction with the accompanying drawings wherein:

FIG. 1 shows a perspective view of a bird incorporating the invention hereof mounted to a structure, such as a handlebar;

FIG. 2 shows a sectional view through the midline of the bird shown in FIG. 1 with the wing in the upward position;

FIG. 3 shows a connecting portion of the support of the toy as seen along lines 3—3 of FIG. 2;

FIG. 4 shows a sectional view of the bird of FIG. 1 along the midline thereof with the wing in the down position;

FIG. 5 shows a view of the bracket opening into which the member shown in FIG. 3 is seated;

FIG. 11 shows a view of the connection device of the tail of FIG. 8 through lines 11—11 of FIG. 8;

DESCRIPTION OF THE PREFERRED EMBODIMENTS

Looking more particularly at FIG. 1 and the other figures that are ancillary thereto, it can be seen that a bird in the form of a gosling 10 is shown.

Figures 6, 7, 8, 9, 10, 12, 13:
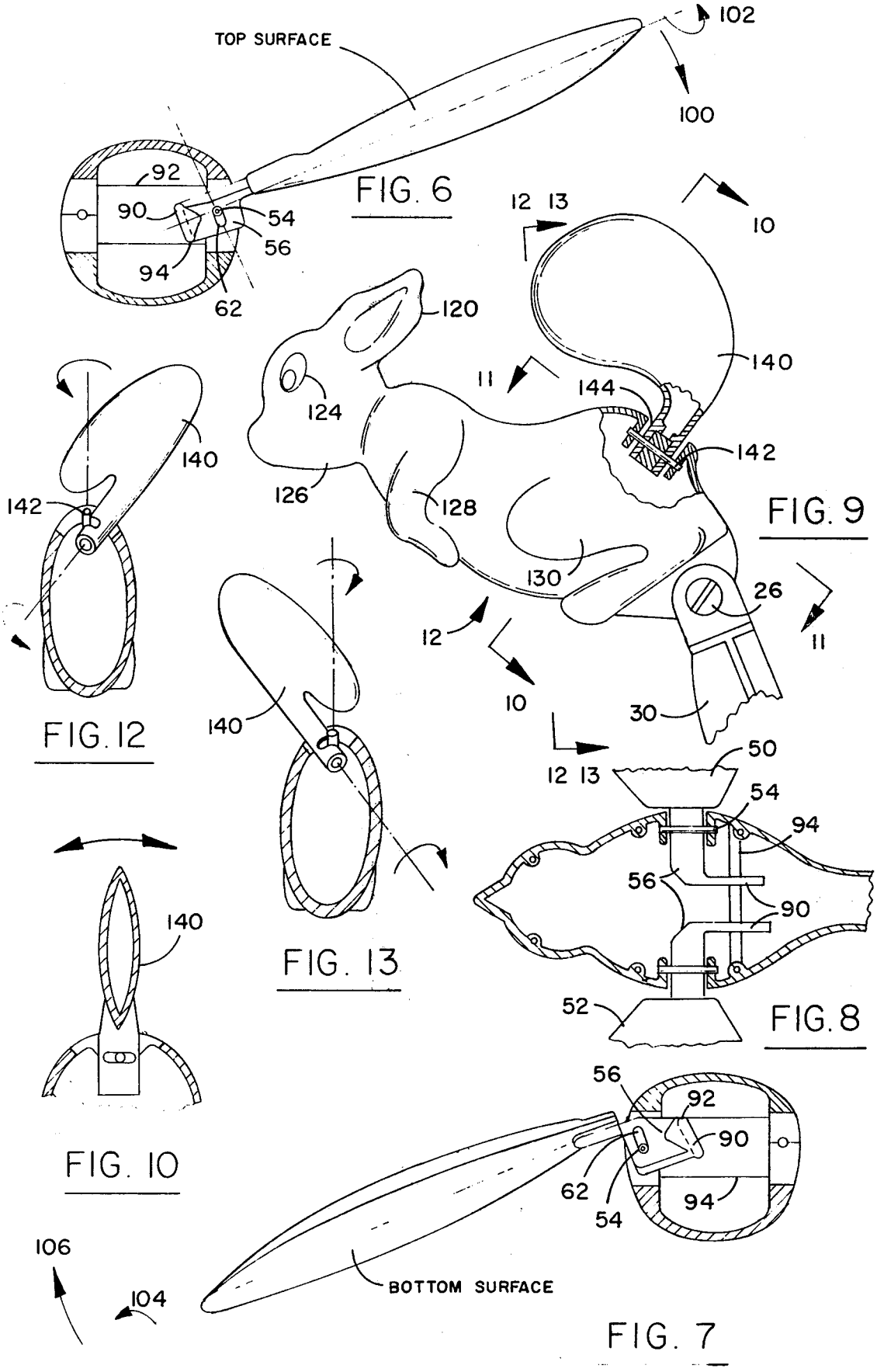
FIG. 6 shows a partially sectioned view of the bird's body with the wing through the midportion of the connection portion of the wing when it is in the upward position being ready to be turned downwardly.
FIG. 7 shows the wing in the downward position when it is being ready to be turned upwardly for movement.
FIG. 8 shows a plan fragmented sectional view of the invention through the midline thereof showing the wing interior operating levers thereof.
FIG. 9 shows an alternative toy wherein the tail moves.
FIG. 10 shows a sectional view of the tail movement at its midpoint as shown along lines 10—10 of FIG. 9.
FIG. 12 shows a sectional view of the tail section as it is connected to the toy of FIG. 9 in the direction of lines 11—11 of FIG. 9.
FIG. 13 shows a sectional view of the tail of FIG. 9 along lines 13—13 of FIG. 9.

The alternative figures ancillary to FIG. 10 show a beaver, a squirrel, or some other animal such as a rabbit 12. Both of the foregoing embodiments incorporate two different configurations in order to provide the animation of this invention. In order to clarify this invention, the first embodiment will be exemplified by the following details of the specification related to the bird 10.

The bird 10 can be formed of a molded body 14 having the shape of a bird with a beak 16 and an eye 18. The bird also incorporates a tail 20 so as to render the appearance of a flapping gosling when it is in flight.

The bird structure has a lower extension or attachment appendage 22 with a hole 24 therethrough. The hole 24 is secured with a screw 26 that secures an overlying sleeve 28 to a brace 30. The brace 30 is formed of a depending element having a series of braces in quadrants all the way around the configuration. The brace 30 terminates in a rounded base 32 having a four quadrant insert 34 which is received within a bracket 36. The four quadrant insert 34 has a series of radially extending members in the form of a cross, namely radially extending members that are shown as appendages 38.

The radially extending members 38 are received within a like configured portion of the bracket 36 having an upper portion 40 and a lower portion 42 that clamps on a handlebar 44. The upper and lower portions 40 and 42 are secured by screws 46 and 48 that allow for a clamping of the bracket 36 to the handlebar 44 when the screws 46 and 48 are drawn down on the handlebar. This creates a binding or gripping force on the handlebar 44.

When the screw 26 is secured through the opening 24 and is tightened down and the respective screws 46 and 48 are tightened down, the gosling or bird 10 does not tend to move and is rigidified in place except for the movement of its animated portions which shall be expanded upon.

In addition thereto, the bird 10 can be oriented in various attitudes. In other words, the bracket 36 can be turned sideways if the mounting is to be on a vertical surface, rather than the horizontal surface as shown. In this manner, the mounting bracket 36 can be turned to accommodate the post of a bicycle or the handlebars and the respective orientation of the bird 10 will always be so that the wings are flapping on the generally horizontal position.

Thus, the quadrant cross-shaped mount can be oriented in any suitable manner to provide the foregoing orientation of the bird so that it can be rotated 360° and mounted every 90° at various orientations.

The bird 10 has a pair of wings, namely wing 50 and a second wing, wing 53, that appear on the left and the right respectively when looking at the front of the bird. The wings flap up and down whereby they provide an animated appearance. The wings are fundamentally formed from a plastic molding operation or can be formed in any other suitable manner to provide the operational features of this invention. Each wing is supported by means of a pin 54 which passes through an appendage or extension of the wing 56.

The appendage of the wing 56 is formed with an opening which has a narrow neck 58 through which the pin 54 passes. The narrow neck 58 has an expanded opening on either side in the form of a conical section 60 and 62. The conical sections 60 and 62 on either side allow for the wing to flap around its axis upwardly and downwardly and at the same time to also rotate around the axial center of the appendage 56, so that it can flap upwardly and downwardly. In this manner, the wing not only flaps upwardly and downwardly as it moves from the bottom to the top of its operational mode that will be expanded upon, but can also go from a positive to a negative lift position by canting or orienting backwardly and forwardly around the pin 54 to the limits of the surfaces of the conical interior portions 60 and 62. Thus, a positive or negative dihedral can be established by virtue of the rotation of the wing element or appendage 56 and of course the extended wing to which it is connected.

The wing can be formed so that it has a special positive and negative dihedral when it rotates around its axis. The showing of FIGS. 2 and 4 indicate a general configuration of the wing prior to moving through its axis respectively in a downward mode and an upward mode after it is moved through the two respective movements.

Figure 14:
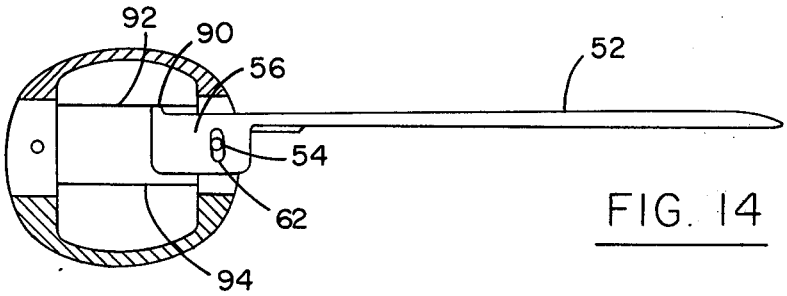
FIG. 14 shows the wing of the bird shown in FIG. 1 in a neutral position when it is being rotated into a positive postion when passing through mid-center.
Figure 15:
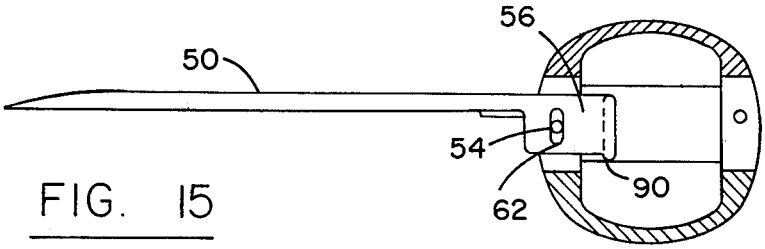
FIG. 15 shows an opposite view of the wing when it is being rotated into negative lift position from that of FIG. 15.

Looking more particularly at FIGS. 6, 7, 14, 15, 16 and 17, it can be seen that the wing, in particular, the right wing 52 in FIG. 14 and the left wing 50 in FIG. 15, are shown through their operative modes, wherein the appendages 56 are held so that they can move upwardly and downwardly on the pin 54. The fundamental showing is that of the wing in both cases of FIGS. 14 and 15 moving through a substantially operative mode going through a neutral position after they have respectively moved downwardly in FIG. 14 and upwardly in FIG. 15. The movement is one wherein the wings cant around a point of center, namely the pin 54 as can be seen more readily in FIGS. 16 and 17.

In effect, what happens is a positive displacement of the wing moves the wing upwardly into an extreme position as can be seen in FIG. 1. At this point, the wing begins to rotate into a downward position. To effect this action, a plurality of support ribs 80 and 82 provide only the function of holding the wings and the appendages 56 in their operative postion. The appendages 56, of course, are supported on the pin 54 as can be seen in the figures. Fundamentally, the foregoing ribs 80 and 82 are merely for support purposes and tend to rigidify and reinforce the body of the bird 10.

Each appendage 56 has an operating arm 90 which provides the function of the turning movement as previously exemplified. The left wing 50 and the right wing 52 each have the respective operating arms 90 turning backwardly in the direction of the rear of the bird. The operating arms 90 operate against controlling surfaces or ribs 92 and 94. The upper and lower ribs 92 and 94 provide controlling surfaces at their leading edges which intercept the operating arm 90 so that it will function.

Figure 16:
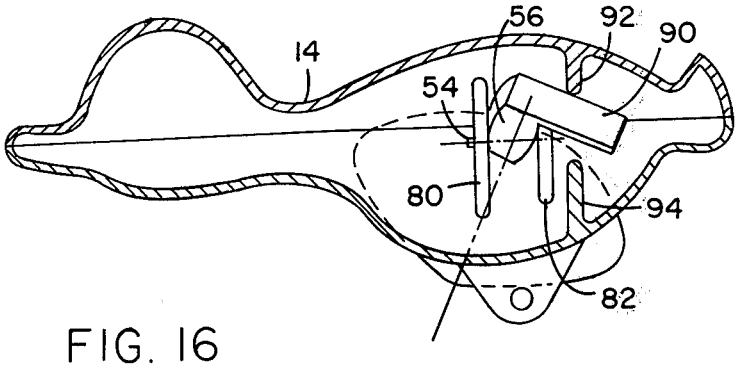
FIG. 16 shows a partially perspective view through the midline section of the bird of FIG. 1 showing the wing being rotated in the foregoing figures into a positive lift position; and, FIG. 17 shows the wing being rotated as in FIG. 16 bent into a negative lift position.

As can be seen in FIGS. 14 and 15, the wings are in a neutral mode going through dead center and the operating arms 90 are in contact with the operational ribs, respectively 92 and 94. At this junction, the wing in FIG. 14 has passed down into its downward mode and the appendage 56 is about to be torqued or twisted into an upward mode to provide positive lift. In other words, as can be seen in FIG. 16, after the wing has dropped downwardly, it is placed into a positive lift mode by the operating arm 90 contacting the rib 92 so that it displaces the wing to twist it upwardly and provides positive lift.

Figure 17:
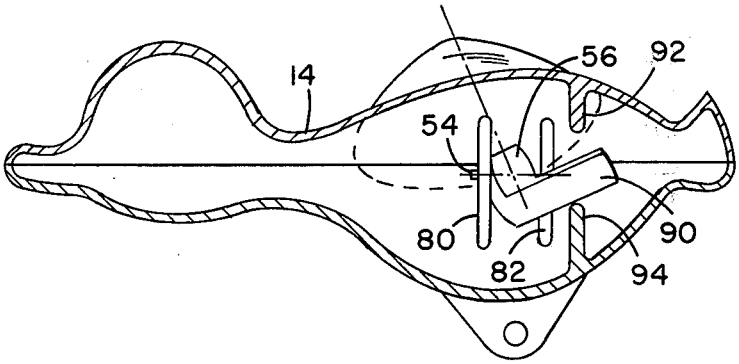

In opposite like manner, when the wing as shown in FIGS. 15 and 17 passes through the neutral position and is in the upward mode, the operating arm 90 bottoms against the rib 94 so that it torques to provide a negative lift so that it forces the wing downwardly. In this manner, it can be seen wherein the wing operates to move through a positive lift movement at which time at the top of its movement it turns downwardly to provide negative lift. After it is turned downwardly with the negative lift, it is then operated so that it is turned positively to provide positive lift at the bottom of its movement. In this manner, the wing flaps upwardly and downwardly.

The foregoing operation can be seen more effectively in FIGS. 6 and 7, wherein the top surface is exposed to provide negative lift, as seen in FIG. 6 when the wing is at the height of its travel, in order to force it downwardly in the direction of arrow 100 and torque it around the center axis shown by arrow 102. In FIG. 7, it can be seen that the wing has been placed in its bottom mode, at which time the switching movement is such that the wing twists in the direction of arrow 104 to provide lift in the direction of arrow 106. Thus, the wing moves through an operative mode, whereby it goes to the top and then cants downwardly to provide negative dihedral by the operation of the arm 90 twisting downwardly and then in the bottom mode turns upwardly by the operation of the arm 90 turning it into an upward position to provide positive lift. In this manner, the wings 50 and 52 flap upwardly and downwardly to give an animated movement to the bird as it moves along through an air stream.

Looking more particularly at the alternative embodiments, it can be seen that a rabbit, beaver or squirrel 12 having ears 120 and eyes 124 and a head 126 is shown. The body is such that it is formed with legs 128 in front and legs 130 in the rear. The body 12 is attached by means of the same screw type fitting with a screw 26 attached to the member 30. In this manner, the squirrel 12 can be turned in any direction.

Looking more particularly at the operative features of the squirrel 12, it can be seen wherein a tail 140 is shown attached to a pin 142. The pin 142 supports an appendage 144 of the tail 140. Within the tail, as can be seen in FIG. 10, is a truncated angular slot at either end, namely a slot having an opening 150 and a second opening 152 to allow for the appendage 144 or the tail to move backwardly and forwardly with respect to the openings 150 and 152.

When the tail swings to one particular point, as shown in FIG. 13, it cants it in the direction whereby it can pick up lift from the wind and move in the opposite direction as shown by the arrows incorporated therein. When it moves in the opposite direction as shown in FIG. 12, after being driven in the direction from FIG. 13, it rotates over and cants to drive it backwardly and forwardly in a wagging manner by the relative wind.

The midpoint is shown in FIG. 10 wherein the tail 140 is at dead center and has not been canted in one direction or the other. The canting literally moves the tail so that it is cocked in order to pick up the wind and cause it to flip to the other side. The cocking is caused by the openings 150 and 152 allowing the surfaces on either side thereof to roll the tail over to a positive displacement mode, so that it can receive a gust of wind or aerodynamic forces to move it backwardly and forwardly in a wagging manner.

As can be seen from the foregoing, the bird 10 with its operative wings that provide the negative lift at the top of the positive lift action and the positive lift at the bottom of the negative lift action, allows the flapping thereof. While in the second embodiment, a positive lift is provided on either side as the tail of the animal moves backwardly and forwardly. Thus, the invention is a broad step over mechanically animated toys and in particular, toys which involve movement through cyclical fluctuations.

I claim:

1. A bird having a body and moving wings attached thereto which can be driven by relative wind passing over said bird comprising:

a bird body;

means attached to said body for mounting it to a vehicle;

wings adapted for connection to said body having appendages that are pivotally mounted to said body to provide upward and downward flapping movement with expanded openings at said pivotal mounting in said wings to allow the wings to rotate about their axes; and, lever means in attached cooperative relationship with said appendages for providing a canting movement of said wing after it moves through its path of movement in one direction to allow relative wind to move the wing in the other direction by virtue of the canting action turning the element to allow for it to be driven by the relative wind for opposite movement from the path of moevement it has moved through.

2. The bird as claimed in claim 1 further comprising:

operating arms forming said lever means attached to said appendages in angular relationship therefrom and extending laterally from the axis of said wings.

3. The bird as claimed in claim 2 further comprising:

operating surfaces in part providing a means against which said operating arms act; and wherein, said surfaces are at least two in number in the upper and lower position so that as said wing moves upwardly it engages an operating surface to turn the wing downwardly to provide negative lift and when the wing moves downwardly the operating arm contacts the upper operating surface to provide lift by canting the wing upwardly.

4. The bird as claimed in claim 3 further comprising:

operating arms in substantially trailing relationship to said wings in laterally displaced relationship therefrom; and wherein, said wing is attached by means of a pin passing through said expanded openings and into the body of said bird.

5. The combination as claimed in claim 4 wherein:

said wing is provided with a positive dihedral surface in the form of an airfoil cross section.

6. A toy bird for attachment to a moving vehicle having wings that articulate under aerodynamic forces when the vehicle is moving comprising:

a bird body;

means for mounting said bird body on said vehicle;

a pair of wings for connection to said bird body;

a pin for connecting each of said wings to said bird;

a member connected to said wings having an expanded opening through which said pin passes, which allows said wing to move upwardly and downwardly and be canted about its axis;

an operating arm connected to said wings laterally from the axis of said wings and having surfaces internally oriented in said bird body; and, internal surfaces within said bird body for engaging said operating arm when said wings move to a maximum extent in either the up or down direction in a manner whereby they can be canted by said surfaces contacting said arms and moving them into the opposite direction for applying aerodynamic forces for driving the wings in the direction previously from which the wings moved.

* * * * *